US009527308B2

(12) United States Patent
Gila et al.

(10) Patent No.: US 9,527,308 B2
(45) Date of Patent: Dec. 27, 2016

(54) SUBSTRATE TREATMENT APPARATUS, PRINTERS, AND METHODS TO TREAT A PRINT SUBSTRATE

(71) Applicant: Hewlett-Packard Development Company, L.P., Houston, TX (US)

(72) Inventors: Omer Gila, Cupertino, CA (US); Daihua Zhang, Tianjin (CN); Tom Anthony, Sunnyvale, CA (US); Hou T. Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/567,874

(22) Filed: Dec. 11, 2014

(65) Prior Publication Data

US 2015/0091975 A1 Apr. 2, 2015

Related U.S. Application Data

(62) Division of application No. 13/194,367, filed on Jul. 29, 2011.

(51) Int. Cl.
*B41F 9/10* (2006.01)
*B41F 23/00* (2006.01)
(Continued)

(52) U.S. Cl.
CPC ..... *B41J 11/0015* (2013.01); *B05C 1/0817* (2013.01); *B05C 1/0834* (2013.01);
(Continued)

(58) Field of Classification Search
CPC .. B41M 5/0017; B41M 7/0018; B05C 1/0834; B05C 1/0817; B41F 23/00; B41F 9/08; B41F 9/10; B41F 9/1036; B41F 9/1072; B41F 9/1081; B41F 9/109
(Continued)

(56) References Cited

U.S. PATENT DOCUMENTS 491,240 A * 2/1893 Crompton ..... B41F 9/1036 101/169
4,590,855 A * 5/1986 Schommer ..... B41F 31/027 101/157
(Continued)

FOREIGN PATENT DOCUMENTS

JP 57204267 A * 12/1982
JP 2002370054 A * 12/2002

OTHER PUBLICATIONS

United States Patent and Trademark Office, "Restriction Requirement," issued in connection with U.S. Appl. No. 13/194,367, Dec. 24, 2013, 9 pages.
(Continued)

*Primary Examiner* — Leslie J Evanisko
(74) *Attorney, Agent, or Firm* — Hanley Flight & Zimmerman LLC

(57) ABSTRACT

Substrate treatment apparatus, printers, and methods to treat a print substrate are disclosed. An example apparatus includes a first roller having a rigid surface to receive a treatment fluid from a reservoir, a blade to apply a first pressure to the first roller to adjust an amount of the treatment fluid present on the first roller, and a second roller having a non-rigid surface to apply a second pressure to the first roller, to receive an adjusted amount of the treatment fluid from the first roller and to apply the treatment fluid to a substrate, the first pressure and the second pressure being selected such that the second roller applies the treatment fluid to the substrate in an amount resulting in a layer of treatment fluid less than about 0.4 micrometers thick on the substrate.

24 Claims, 4 Drawing Sheets

(51) Int. Cl.

| | |
|---|---|
| ***B05C 1/08*** | (2006.01) |
| ***B41J 11/00*** | (2006.01) |
| ***B41M 5/00*** | (2006.01) |
| ***B41M 7/00*** | (2006.01) |

(52) U.S. Cl.
CPC ..... *B41F 9/10* (2013.01); *B41F 9/1072* (2013.01); *B41F 23/00* (2013.01); *B41M 5/0017* (2013.01); *B41M 7/0018* (2013.01)

(58) Field of Classification Search
USPC ..... 118/211, 212, 236, 46, 300, 260–261,118/264, DIG. 1, 413; 101/424.2, 153, 154, 155, 101/157, 167, 169; 162/281; 15/256.5, 256.51
See application file for complete search history.

(56) References Cited

U.S. PATENT DOCUMENTS

| | | | | |
|---|---|---|---|---|
| 4,805,530 | A | 2/1989 | Kobler et al. | |
| 5,070,783 | A | 12/1991 | Ireton | |
| 5,078,061 | A * | 1/1992 | Messerschmitt | B41F 15/44 101/123 |
| 5,440,982 | A * | 8/1995 | Meadows | B41F 31/027 101/363 |
| 5,694,842 | A * | 12/1997 | Casl | B41F 15/44 101/114 |
| 5,869,131 | A | 2/1999 | Henke et al. | |
| 6,015,624 | A | 1/2000 | Williams | |
| 6,293,668 | B1 | 9/2001 | Kubby et al. | |
| 6,854,823 | B2 | 2/2005 | Rutland et al. | |
| 7,571,999 | B2 | 8/2009 | Kovacs et al. | |
| 7,780,773 | B2 | 8/2010 | Kovacs et al. | |
| 7,794,835 | B2 | 9/2010 | Katano et al. | |
| 2006/0075916 | A1 | 4/2006 | Edwards et al. | |
| 2007/0243483 | A1 | 10/2007 | Katano et al. | |
| 2009/0158946 | A1 | 6/2009 | Roth et al. | |
| 2009/0311426 | A1 | 12/2009 | Nakazawa et al. | |
| 2010/0218693 | A1 | 9/2010 | Kozdras | |
| 2010/0230038 | A1 | 9/2010 | Gila et al. | |
| 2010/0242757 | A1 | 9/2010 | Laksin et al. | |
| 2013/0025483 | A1 | 1/2013 | Gila et al. | |

OTHER PUBLICATIONS

United States Patent and Trademark Office, "Non-final Office Action," issued in connection with U.S. Appl. No. 13/194,367, Mar. 6, 2014, 16 pages.

United States Patent and Trademark Office, "Final Office Action," issued in connection with U.S. Appl. No. 13/194,367, Sep. 11, 2014, 18 pages.

* cited by examiner

SUBSTRATE TREATMENT APPARATUS, PRINTERS, AND METHODS TO TREAT A PRINT SUBSTRATE

RELATED APPLICATIONS

This patent arises from a divisional of U.S. patent application Ser. No. 13/194,367, filed Jul. 29, 2011. The entirety of U.S. patent application Ser. No. 13/194,367 is incorporated herein by reference.

BACKGROUND

In printing applications, substrate pretreatment is the application of a substance to a print substrate prior to forming the image on the substrate. Substrate posttreatment is the application of a substance to a print substrate after forming the image on the substrate.

DETAILED DESCRIPTION

Figure 1:
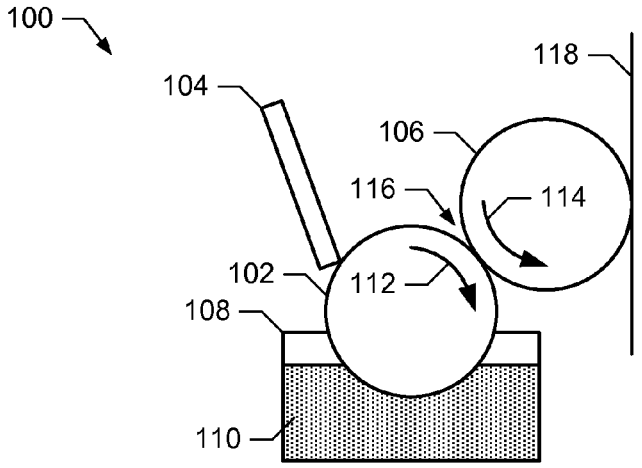
FIG. 1 illustrates an example substrate treatment apparatus constructed in accordance with the teachings of this disclosure.

Paper pretreatment is used to improve paper adhesion. For instance, the HP Indigo® 7200 printing press, which is a web double engine tandem press, includes a known in line priming pretreatment device to pretreat paper prior to printing on the paper. The pretreatment improves ink transfer to the paper as well as adhesion of the image. However, the known in line priming device can be expensive and requires a relatively large physical space to pretreat and dry the paper. To pretreat the paper, the known in line priming device provides an approximately one micron-thick layer of water-based primer on the substrate. The primer includes a priming substance dissolved or suspended in the water. The water in the layer should be evaporated before the paper enters the press. This evaporation problem is increased as the printing speed increases. Typical priming apparatus use long chains of rollers to reduce a layer thickness and/or substantially dilute the treatment fluid in a carrier such as water to apply a desired amount of treatment material.

Example apparatus and printers disclosed herein may be advantageously used to pre-treat and/or post-treat a print substrate with a layer of treatment fluid. Disclosed example apparatus and printers have several advantages over known priming apparatus, including providing substantially thinner layers of treatment fluid onto a substrate. Further, example apparatus and printers disclosed herein may be implemented using significantly less space and lower cost than known priming apparatus. Example apparatus and printers disclosed herein may also use treatment fluid having a lesser proportion of carrier fluid, which significantly reduces the energy needed to remove the carrier fluid in a high-speed printing process. In some examples, the carrier fluid of disclosed apparatus and/or printers is compatible with the printing process and does not need to be removed prior to entering the printing engine.

A disclosed example substrate treatment apparatus includes a first roller to receive a treatment fluid from a reservoir, a doctor blade to apply a pressure to the first roller to adjust an amount of the treatment fluid present on the first roller, and a second roller to receive an adjusted amount of the treatment fluid from the first roller and to apply the treatment fluid to a substrate. In some examples, the second roller applies the adjusted amount of the treatment fluid to the substrate such that the treatment fluid forms a layer less than 0.4 microns (micrometers, μm) on the substrate. In some examples the substrate treatment apparatus has a substantially lower cost compared to known paper pretreatment devices, has a substantially small physical size compared to known paper pretreatment devices, and/or may be used for both pretreatment and posttreatment applications.

A disclosed example method to treat a print substrate, which may be performed using example substrate treatment apparatus disclosed herein, includes applying a layer of a treatment fluid from a reservoir to a first roller and removing at least a portion of the treatment fluid from the first roller to form a substantially uniform first coating of treatment fluid on the first roller. The disclosed example method further includes transferring at least a portion of the treatment fluid from the first roller to a second roller to form a substantially uniform second coating of the treatment fluid on the second roller, the second coating having a thickness less than the first coating, and transferring at least a portion of the treatment fluid from the second roller to the print substrate to form a substantially uniform third coating of the treatment fluid on the print substrate.

In some examples, a treatment fluid includes an oil-based carrier fluid, such as an Isopar™-based fluid. Isopar is an isoparaffinic fluid manufactured and sold by ExxonMobil Chemical. In some examples, a polyethylene acrylic acid copolymer is dissolved in Isopar L to form the treatment fluid. In some other examples, the treatment fluid includes a water or water-based carrier fluid, and the first and/or second rollers are coated with a hydrophilic material.

FIG. 1 illustrates an example substrate treatment apparatus 100. The example substrate treatment apparatus 100 of FIG. 1 may be used in combination with a printing engine or other image forming apparatus (e.g., a commercial offset printer) to pretreat and/or posttreat a print substrate on which an image is to be printed. In some examples, the substrate treatment apparatus 100 of FIG. 1 may be used separately from a printing engine or image forming apparatus to apply a thin (e.g., less than 1 micron thick), substantially uniform layer of treatment fluid to a substrate. For example, the substrate treatment apparatus 100 may be used in a post-treatment application to apply a treatment fluid, such as a de-inking fluid, to a printed substrate in preparation to recycle the substrate.

The example substrate treatment apparatus 100 of FIG. 1 includes a first roller 102, a doctor blade 104, a second roller 106, and a reservoir 108. The illustrated example reservoir 108 contains a quantity of treatment fluid 110. The example first roller 102 of FIG. 1 is constructed using a rigid material, such as a metal, hard plastic, or other rigid material. In some examples, the first roller 102 is an anilox roller. The first roller 102 rotates in a first direction 112, where at least a portion of the first roller contacts the treatment fluid 110. As the first roller 102 rolls, the first roller 102 collects or holds a first amount of the treatment fluid 110.

The example doctor blade 104 of FIG. 1 is a rubber or foam blade that applies a pressure to the surface of the first roller 102. In the illustrated example of FIG. 1, the doctor blade 104 makes contact with the first roller 102 at a location following the location where the surface of the first roller 102 rotates out of the reservoir 108. Between exiting the reservoir and coming into contact with the doctor blade 104, the surface of the first roller 102 carries a comparatively high amount of the treatment fluid 110. When the surface of the first roller 102 contacts the doctor blade 104, the doctor blade 104 removes at least a portion of the treatment fluid 110 from the first roller 102. The surface of the example first roller 102 retains a layer of the treatment fluid 110 that is based on the shape of the doctor blade 104 and/or the pressure applied to the surface of the first roller 102 by the doctor blade 104. In examples in which the first roller 102 is an anilox roller, the quantity of treatment fluid 110 remaining on the first roller 102 is also based on the pattern and/or the depth of the anilox depressions.

The surface of the example first roller 102 continues to roll until the surface contacts the second roller 106. The second roller 106 of FIG. 1 is constructed using a softer, pliable material such as foam or rubber. The example second roller 106 of FIG. 1 rotates in a second direction 114 such that the surfaces of the first roller 102 and the second roller 106 move in the same direction at a nip 116 between the rollers 102, 106. In some examples, the respective surfaces of the rollers 102, 106 have the same or similar speed at the nip 116 to reduce shear. As the surface of the second roller 106 contacts the first roller 102, the second roller receives a portion of the treatment fluid 110 from the surface of the first roller 102. In the example of FIG. 1, the surface of the second roller 106 has a substantially uniform layer of treatment fluid 110.

The example second roller 106 continues to rotate from the nip 112 to contact a print substrate 118. The second roller 106 applies (e.g., transfers) a substantially uniform layer of the treatment fluid 110 to the print substrate 118 to form a layer of the treatment fluid 110 less than about 0.4 microns thick on the print substrate 118.

In the example of FIG. 1, the treatment fluid 110 is a polyethylene acrylic acid copolymer dissolved in Isopar L. Solubility of polyethylene acrylic acid copolymer in Isopar L at room temperature is about 0.5% by weight, so getting a 10 nm polymer layer requires about 2 microns of the treatment fluid 110. Solubility can be increased and, thus, the coating thickness may be decreased, for a desired amount of polymer by operating the example substrate treatment apparatus 100 at an elevated temperature (e.g., greater than room temperature) and/or by using a polymer having a lower molecular weight. As the temperature of the treatment fluid increases, a higher concentration by weight of the treatment material (e.g., polyethylene acrylic acid copolymer) can be dissolved in the carrier fluid and a thinner layer of treatment fluid can be applied to achieve the same ink adhesion performance.

Advantageously, applying a 0.4 micron-thick layer of Isopar L (e.g., via the rollers 102, 106) requires about 7% of the energy to evaporate than is required to evaporate a 1 micron-thick layer of water applied by known substrate treatment devices. In some examples in which the substrate apparatus 100 is implemented as a pretreatment device to a printing engine that uses an isoparaffin-based ink carrier, the Isopar-based treatment fluid 110 is compatible with the printing engine and does not need be dried before entering the printing engine. Additionally or alternatively, the polyethylene acrylic acid copolymer can be replaced and/or supplemented by other polymers. Alternatively, the general class of amine modified multifunctional polyether acrylates and aliphatic urethane diacrylates can be used as a treatment solid when dissolved in a carrier fluid.

In some other examples, the treatment fluid 110 includes water or a water-based carrier fluid and a treatment solid that is water-soluble. In such examples, the first roller 102 and/or the second roller 106 are coated with hydrophilic materials to reduce or prevent absorption of the treatment material, which could impair the uniformity of the coating applied to the print substrate 118.

Figure 2A:
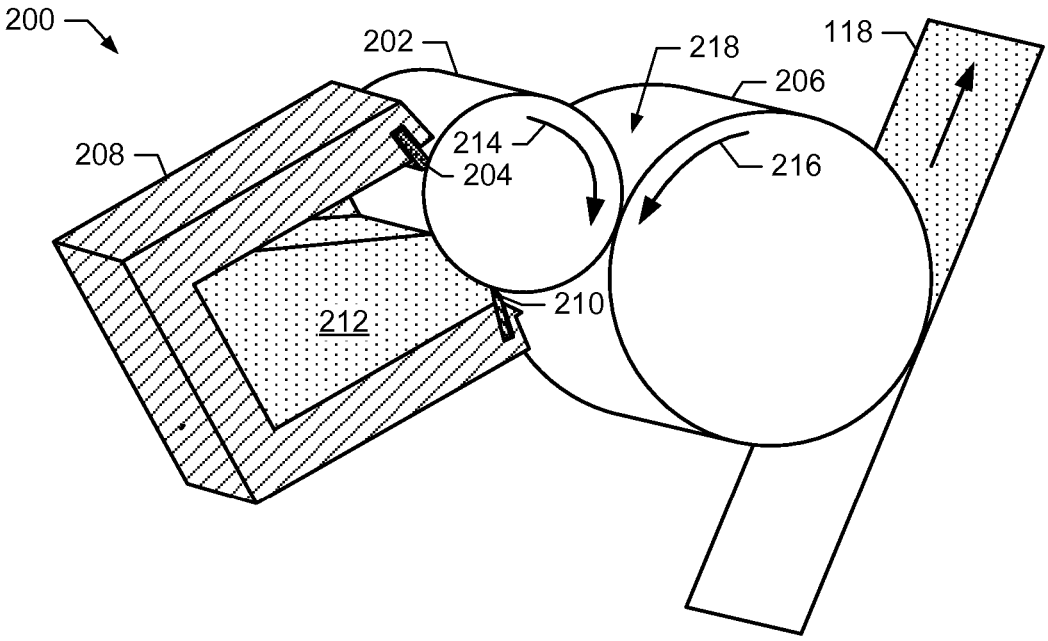
FIG. 2A is a perspective view of an example substrate treatment apparatus having a rubber roller to implement the second roller of FIG. 1.

FIG. 2A is a perspective view of an example substrate treatment apparatus 200 having a rubber roller (e.g., to implement the second roller 106 of FIG. 1). The example substrate treatment apparatus 200 of FIG. 2A may be used to implement the substrate treatment apparatus 100 of FIG. 1 to treat a print substrate prior to and/or subsequent to printing an image on a print substrate (e.g., the print substrate 118 of FIG. 1).

The illustrated substrate treatment apparatus 200 of FIG. 2A includes a first roller 202, a doctor blade 204, a rubber second roller 206, a reservoir 208, and a seal 210. The reservoir 208 contains treatment fluid 212, which is to be applied to a print substrate 118.

Figure 4:
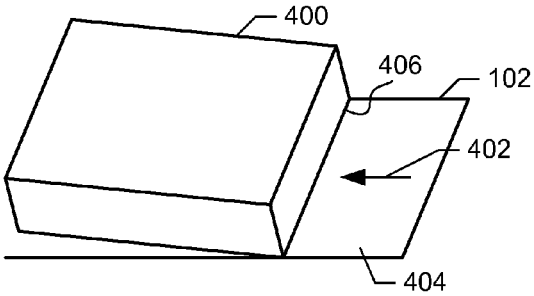
FIG. 4 is a perspective view of an example doctor blade that may be used to implement the substrate treatment apparatus of FIG. 1.
Figure 5:
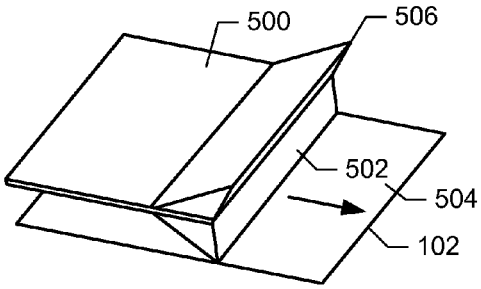
FIG. 5 is a perspective view of another example doctor blade that may be used to implement the substrate treatment apparatus of FIG. 1.

In the example of FIG. 2A, the first roller 202 rotates in a direction 214 to collect treatment fluid 212 from the reservoir 208. The seal 210 reduces or prevents leakage of the treatment fluid 212 below the first roller 202. As the first roller 202 rotates, the first roller 202 is coated with the treatment fluid 212 from the reservoir 208. The example doctor blade 204 of FIG. 2A is in contact with the first roller 202 to set a thickness of the treatment fluid 212 on the first roller 202, which also affects the thickness of the treatment fluid 212 on the second roller 206 and the substrate 118. To this end, the doctor blade 204 applies a pressure to the first roller 202, where the amount of applied pressure controls the thickness of the layer of treatment fluid 212 on the first roller 202. Excess treatment fluid 212 is removed from the first roller 202 by the doctor blade 204 and may return to the reservoir 208. The thickness of the layer of treatment fluid 212 left on the first roller 202 by the doctor blade 204 is based on a pressure between the doctor blade 204 and the first roller 202, the shape of the doctor blade 204, the orientation of the doctor blade 204 relative to the first roller 202, and/or the hardness of the doctor blade 204. Example doctor blades that may be used to implement the doctor blades 104, 204 of FIGS. 1 and 2 are illustrated in FIGS. 4 and 5.

The second roller 206 rotates in a second direction 216, opposite the first direction 214, to receive treatment fluid 212 from the first roller 202. By rotating in the second direction 216, the example rubber second roller 206 experiences a reduced shear force at a nip 218 between the first roller 202 and the rubber second roller 206. As the rubber second roller 206 rotates, the roller 206 is coated with the treatment fluid 212 from the first roller 202. In some examples, about half of the treatment fluid 212 coating the first roller 202 is transferred to the rubber second roller 206. The rubber second roller 206 rotates to transfer the treatment fluid 212 (received from the first roller 202) to the print substrate 118. On contact with the print substrate 118, a portion of the treatment fluid 212 on the rubber second roller 206 adheres to the print substrate 118. In this manner, the example substrate treatment apparatus 200 of FIG. 2A treats the print substrate 118 with the treatment fluid 212.

Figure 2B:
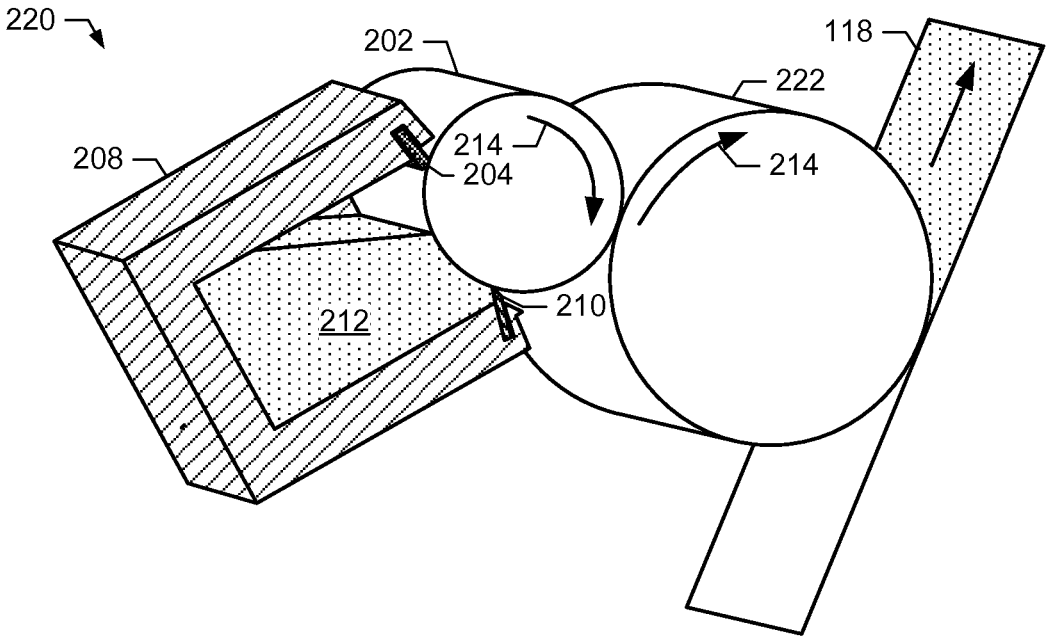
FIG. 2B is a perspective view of the example substrate treatment apparatus having a sponge roller to implement the second roller of FIG. 1.

FIG. 2B is a perspective view of an example substrate treatment apparatus 220 having a sponge roller (e.g., to implement the second roller 106 of FIG. 1). Like the example substrate treatment apparatus 200 of FIG. 2A, the substrate treatment apparatus 220 includes a first roller 202, a doctor blade 204, a reservoir 208 including treatment fluid 212, and a seal 210. The example substrate treatment apparatus 220 includes a sponge second roller 222, which rotates in the first direction 214. As a result, the example sponge roller 220 experiences increased shear force when in contact with the first roller 202 and the substrate 118, which increases the transfer effectiveness of the treatment fluid 212 between the first roller 202 and the sponge second roller 222 and between the second roller 222 and the substrate 118. In some examples, the substrate treatment apparatus 220 transfers the treatment fluid 212 more effectively substrate treatment apparatus 200 of FIG. 2A to substrates 118 having rough surfaces.

Figure 3A:
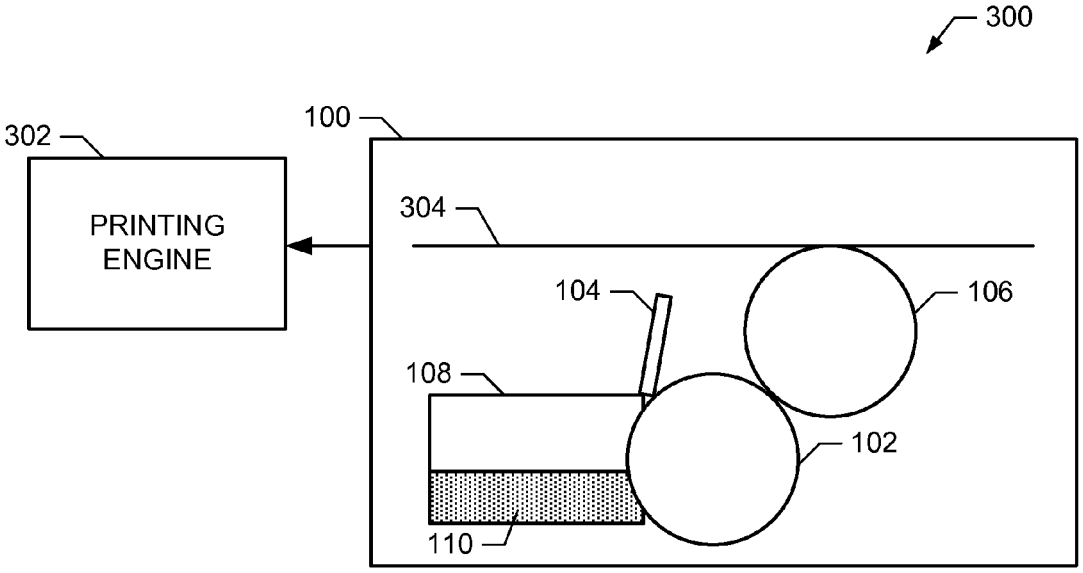
FIG. 3A illustrates an example printer including the example substrate treatment apparatus of FIG. 1.

FIG. 3A illustrates an example printer 300 including the example substrate treatment apparatus 100 of FIG. 1. As illustrated in FIG. 3A, the example printer 300 includes a printer engine and the substrate treatment apparatus 100. As described above, the example substrate treatment apparatus 100 includes the first roller 102, the doctor blade 104, the second roller 106, and the reservoir 108, which contains a quantity of treatment fluid 110. The example printing engine 302 may be one of the Hewlett-Packard Indigo® line of printers.

In the example printer 300, the substrate treatment apparatus 100 pretreats a print substrate 304. The substrate treatment apparatus 100 outputs the treated print substrate 304 to the printing engine 302, which applies a marking agent to the substrate to form an image. In the example of FIG. 3, the marking agent applied by the printing engine 302 includes a carrier fluid that is compatible (e.g., similar or identical such that the marking agent is not affected) with the carrier fluid of the treatment fluid 110. For example, if the treatment fluid 110 uses isoparaffin as a carrier fluid, a compatible marking agent may include one or more of the HP Electroink™ line of inks.

Figure 3B:
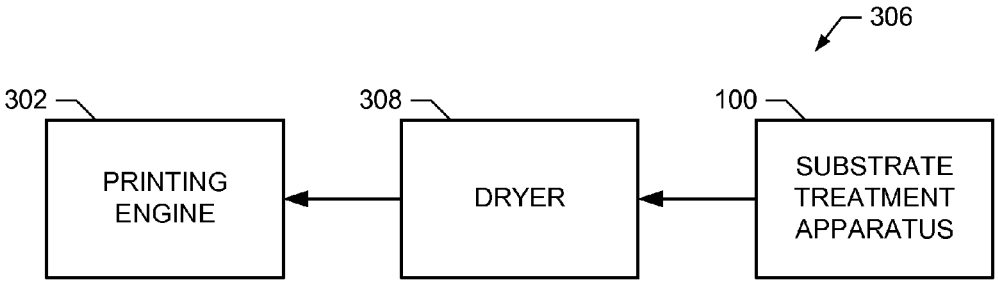
FIG. 3B illustrates another example printer including the example substrate treatment apparatus of FIG. 1 and a dryer

FIG. 3B illustrates another example printer 306 including the example substrate treatment apparatus of FIG. 1 and a dryer 308. The example printer 306 includes the printing engine 302 of FIG. 3A, which receives treated print substrate from the substrate treatment apparatus 100 via the dryer 308.

In the example printer 306 of FIG. 3B, a print substrate (e.g., the print substrate 304 of FIG. 3A) is output from the substrate treatment apparatus 100 coated with a layer of treatment fluid (e.g., the treatment fluid 110 of FIGS. 1 and 3A) containing carrier fluid and treatment solids (e.g., polyethylene acrylic acid copolymer, etc.). In some examples, the layer of treatment fluid 110 is less than 0.4 microns thick. The dryer 308 applies heat to the print substrate 304 to cause the carrier fluid to evaporate from the print substrate 304, leaving only the treatment solids. As a result, the printing engine 302 receives the print substrate 304 having a dry, substantially uniform layer of treatment solids on the treated print substrate 304.

Figure 3C:
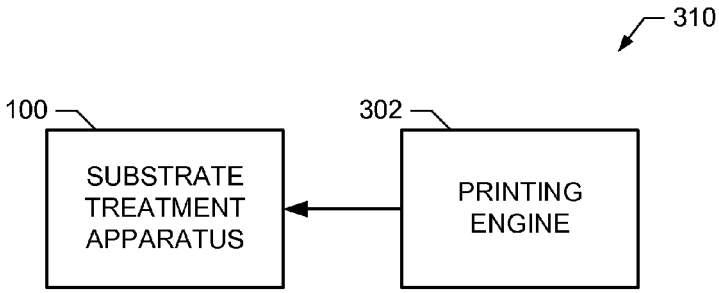
FIG. 3C illustrates another example printer including the printing engine and the substrate treatment apparatus of FIG. 3A.

FIG. 3C illustrates another example printer 310 including the printing engine 302 and the substrate treatment apparatus 100 of FIG. 3A. Unlike the example printers 300, 306, the example printer 310 of FIG. 3C includes the substrate treatment apparatus 100 as a posttreatment device.

As a posttreatment device, the example substrate treatment apparatus 100 of FIG. 3C receives a print substrate (e.g., the print substrate 304 of FIG. 3A) having a printed image. In some examples, the printed image is dried (e.g., a hard image) when received at the substrate treatment apparatus 100. The example substrate treatment apparatus 100 applies a treatment fluid (e.g., the treatment fluid 110 of FIGS. 1 and 3A) to the print substrate 304 to coat the printed image (e.g., to protect the image from damage, etc.). In some examples, the treatment solid used as a posttreatment fluid is a clear, unpigmented polymer similar to the pigmented polymers in the ink of the printed image.

FIG. 4 is a perspective view of an example doctor blade 400 that may be used to implement the substrate treatment apparatus 100 of FIG. 1. The example doctor blade 400 of FIG. 4 may be positioned in contact with a first, rigid roller of a substrate treatment apparatus (e.g., the first roller 102, 202 of FIGS. 1 and 2) to remove excess treatment fluid coating the roller. The example doctor blade 400 is constructed using a partially flexible material to conform to the surface of a rigid roller, but is sufficiently resilient to apply a desired pressure to the surface of the roller to establish a desired coating thickness of treatment fluid on the roller.

As illustrated in FIG. 4, the doctor blade 400 is a cut or molded piece of material placed at an angle against a direction of travel 402 of a surface 404 (e.g., the first roller 102, 202). In some examples, the doctor blade 400 is placed at an angle against the surface 404 moving in a direction opposite the illustrated direction of travel 402. In the illustrated example of FIG. 4, the direction of travel 402 will result in a thinner layer with a given pressure, speed, angle, shape, and material of the doctor blade 400. A leading edge 406 of the example doctor blade 400 may be shaped in any desired manner and/or applied at a desired angle to the surface 404 to establish a desired pressure.

FIG. 5 is a perspective view of another example doctor blade 500 that may be used to implement the substrate treatment apparatus 100 of FIG. 1. Like the doctor blade 400 of FIG. 4, the example doctor blade 500 of FIG. 5 may be positioned in contact with a roller of the substrate treatment apparatus 100 to remove excess treatment fluid coating the roller. The example doctor blade 500 is constructed using a partially flexible material to conform to the surface of a rigid roller, and is sufficiently resilient to apply a desired pressure to the surface of the roller to establish a desired coating thickness of treatment fluid on the roller. For example, the doctor blade 500 may be constructed using rubber or foam.

The example doctor blade 500 is a fork shaped blade, in which at least one of the prongs 502 is placed into contact with a surface 504. The other of the prongs 506 does not contact the surface 504 in the illustrated example. In some examples, the doctor blade 500 may be reversed after the prong 502 has worn down so that the prong 506 is placed into contact with the surface 504, thereby extending the useful life of the example doctor blade.

Figure 6:
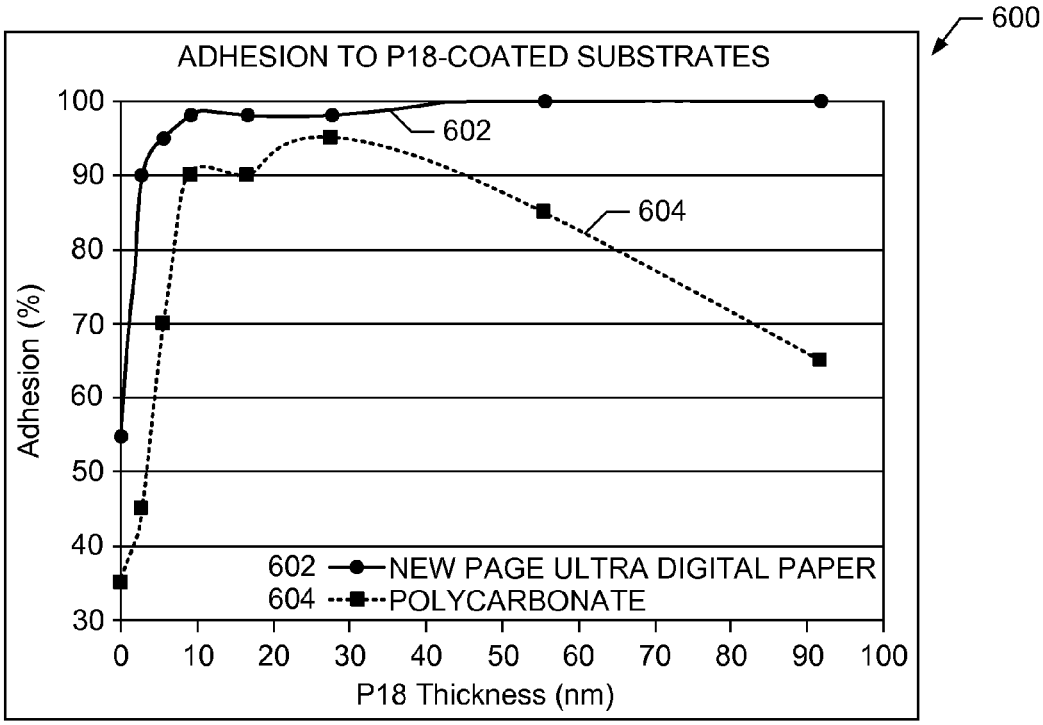
FIG. 6 is a graph illustrating adhesion of ink to an example substrate pretreated using the substrate treatment apparatus of FIG. 1.

FIG. 6 is a graph 600 showing adhesion of ink to example substrates pretreated using a substrate treatment apparatus.

The graph of FIG. 6 illustrates first adhesion measurements 602 to Sterling® Ultra Digital™ paper for HP Indigo™, commercially available from NewPage® Corporation, and second adhesion measurements 604 to a polycarbonate sheet. The measurements 602, 604 represent an amount of ink remaining on the respective sheets after tape peel testing, compared to the amount initially deposited, with respect to a thickness of a layer of treatment material (e.g., polyethylene acrylic acid copolymer) applied to the paper.

As shown in FIG. 6, the treated paper has adhesion over 90% for polyethylene acrylic acid copolymer treatment material layer thicknesses as low as about 3 nm, and increases to over 95% for polyethylene acrylic acid copolymer material layer thicknesses over about 9 nm. In contrast, the polycarbonate substrate has the highest adhesion at about 28-30 nm of polyethylene acrylic acid copolymer treatment material. The adhesion decreases as the thickness of the treatment material is increased or decreased from about 28-30 nm of polyethylene acrylic acid copolymer treatment material.

Figure 7:
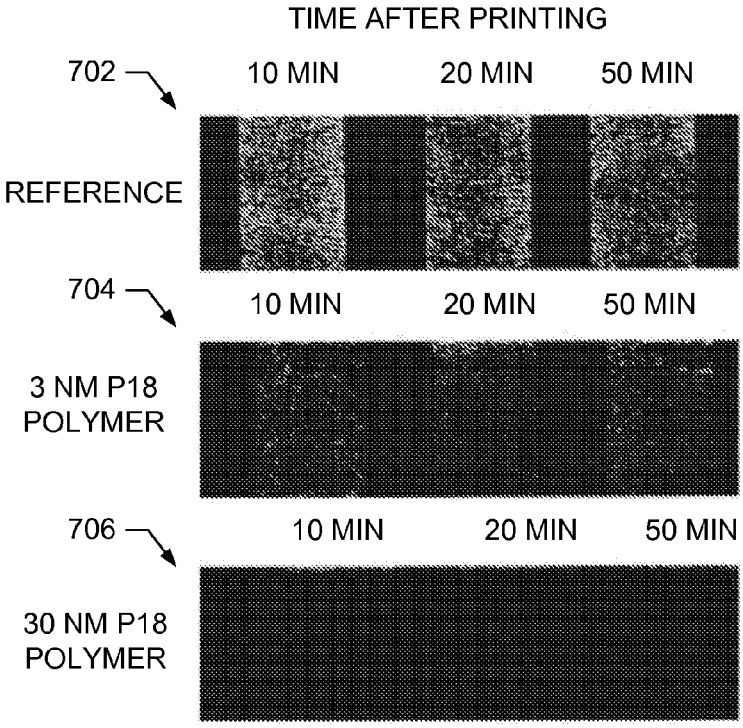
FIG. 7 shows results of tape peel tests on images printed on reference substrates and substrates treated with different amounts of a treatment fluid.

FIG. 7 shows results of tape peel tests on images printed on reference substrates and substrates pretreated with different amounts of a treatment fluid. A first set of results 702 are performed with ink on an untreated substrate at 10, 20, and 50 minutes after printing, respectively. A second set of results 704 are performed with ink on a substrate coated with a 3 nanometer (nm) polyethylene acrylic acid copolymer at 10, 20, and 50 minutes after printing, respectively. A third set of results 706 are performed with ink on a substrate coated with a 30 nanometer (nm) polyethylene acrylic acid copolymer at 10, 20, and 50 minutes after printing, respectively.

As shown in FIG. 7, the treated paper samples have substantially improved adhesion of the ink to the paper compared to the untreated paper. Further, the pretreated paper having a 30 nm layer has improved adhesion of the ink compared to the pretreated paper having a 3 nm layer. Further, the treated paper samples have relatively uniform adhesion, reflecting the substantially uniform layer of treatment fluid applied to the paper by the example substrate treating apparatus 100.

From the foregoing, it will be appreciated that above-disclosed apparatus and printers may be advantageously used to treat print substrates with thin layers of treatment material. Disclosed example apparatus and printers enable the application of treatment fluid and/or treatment material using substantially less energy than known pretreatment apparatus by reducing and or eliminating drying (e.g., via a heater) of treatment material (e.g., carrier fluid) to evaporate the treatment material. Disclosed example apparatus and printers further occupy substantially less physical space than known pretreatment apparatus because large drying heaters or replaced with smaller drying heaters and/or omitted.

Although certain example apparatus, printers, and methods have been disclosed herein, the scope of coverage of this patent is not limited thereto. On the contrary, this patent covers all methods, printers, and apparatus fairly falling within the scope of the claims of this patent.

What is claimed is:

1. A substrate treatment apparatus, comprising:

a first roller to receive a treatment fluid;

a reversible fork having a first prong and a second prong disposed at an end of the fork, the fork being positionable in a first position and a second position relative to the first roller, in the first position of the fork, the first prong to engage the first roller to adjust an amount of the treatment fluid on the first roller, in the second position of the fork, the second prong to engage the first roller to adjust the amount of the treatment fluid on the first roller; and a second roller to receive an adjusted amount of the treatment fluid from the first roller and to apply the treatment fluid to a substrate.

2. A substrate treatment apparatus as defined in claim 1, wherein both the first and second rollers are to either rotate clockwise or rotate counterclockwise.

3. A substrate treatment apparatus as defined in claim 1, wherein the first roller is to rotate in a clockwise direction or a counterclockwise direction, and the second roller is to rotate in an other of the clockwise direction or the counterclockwise direction.

4. A substrate treatment apparatus as defined in claim 1, wherein the fork is at least one of rubber or foam.

5. A substrate treatment apparatus as defined in claim 1, wherein the second roller is to apply the treatment fluid to the substrate prior to a marking agent being applied to the substrate.

6. A substrate treatment apparatus as defined in claim 1, wherein the treatment fluid includes a polymer dissolved in an oil-based fluid.

7. A substrate treatment apparatus as defined in claim 6, further including conserving energy by evaporating the oil-based fluid using about 7% of the energy required to evaporate a 1-micron-thick layer of the treatment fluid.

8. A substrate treatment apparatus as defined in claim 6, wherein the polymer includes at least one of a polyethylene acrylic acid copolymer, an amine modified multifunctional polyether acrylate, or an aliphatic urethane diacrylate.

9. A substrate treatment apparatus as defined in claim 6, wherein the oil-based fluid includes an isoparaffinic fluid.

10. A substrate treatment apparatus as defined in claim 1, wherein the second roller includes a sponge roller.

11. A substrate treatment apparatus as defined in claim 10, wherein the second roller is to rotate in a direction opposing a direction of travel of the substrate at a location at which the second roller applies the treatment fluid to the substrate.

12. A substrate treatment apparatus as defined in claim 1, further including a reservoir from which the first roller is to receive the treatment fluid, the reservoir including a slot to receive the fork.

13. A substrate treatment apparatus as defined in claim 12, wherein the slot is a first slot, the reservoir to define a second slot to receive a seal, the seal having an end disposed adjacent the first roller to deter the treatment fluid from leaking.

14. A substrate treatment apparatus as defined in claim 1, wherein the first prong or the second prong is to apply a first pressure to the first roller, the second roller to apply a second pressure to the first roller, the first pressure and the second pressure being selected such that the second roller applies the treatment fluid to the substrate in an amount resulting in a layer of treatment fluid less than about 0.4 micrometers thick on the substrate.

15. A printer, comprising:

a printing engine to form an image on a substrate;

a first roller to receive a treatment fluid;

a reversible fork having a first prong and a second prong, the first and second prongs disposed adjacent an end of the fork, the fork being positionable in a first position and a second position relative to the first roller, the first prong to engage the first roller in the first position of the fork to adjust an amount of the treatment fluid on the first roller, the second prong to engage the first roller in the second position of the fork to adjust the amount of the treatment fluid on the first roller; and a second roller to receive an adjusted amount of the treatment fluid from the first roller and to apply the treatment fluid to the substrate.

16. A printer as defined in claim 15, wherein the second roller is to apply the treatment fluid to the substrate prior to the printing engine applying a marking agent to the substrate.

17. A printer as defined in claim 16, wherein the treatment fluid includes a polymer dissolved in an oil-based fluid, the fork to apply a first pressure to the first roller, the second roller to apply a second pressure to the first roller, the first pressure and the second pressure being selected such that the second roller applies the treatment fluid to the substrate in an amount resulting in a layer of the treatment fluid less than 0.4 micrometers thick on the substrate.

18. A printer as defined in claim 17, wherein the oil-based fluid is compatible with the printing engine.

19. A printer as defined in claim 15, wherein the second roller is to apply the treatment fluid to the substrate subsequent to the printing engine applying a marking agent to the substrate.

20. A printer as defined in claim 15, further including a dryer to remove at least a portion of the treatment fluid from the substrate prior to the printing engine applying a marking agent to the substrate.

21. A printer as defined in claim 15, wherein the treatment fluid includes at least one of a polyethylene acrylic acid copolymer, an amine modified multifunctional polyether acrylate, or an aliphatic urethane diacrylate.

22. A method to treat a print substrate, comprising:

applying a treatment fluid to a first roller;

removing at least a portion of the treatment fluid from the first roller using a reversible fork having a first prong and a second prong, the first and second prongs disposed adjacent an end of the fork, the fork having a first position and a second position relative to the first roller, the first prong to engage the first roller to adjust an amount of the treatment fluid on the first roller when the fork is in the first position but not when the fork is in the second position, in the second position of the fork, the second prong to engage the first roller to adjust the amount of the treatment fluid on the first roller when the fork is in the second position but not when the fork is in the first position;

transferring at least a portion of the treatment fluid from the first roller to a second roller; and transferring at least a portion of the treatment fluid from the second roller to the print substrate.

23. A method as defined in claim 22, wherein the treatment fluid includes a treatment material and a carrier fluid, the treatment material including at least one of a polyethylene acrylic acid copolymer, an amine modified multifunctional polyether acrylate, or an aliphatic urethane diacrylate, wherein:

the removing of the at least the portion includes removing at least the portion of the treatment fluid from the first roller using the fork to apply pressure to the first roller to form a substantially uniform first coating of the treatment fluid on the first roller;

the transferring of the at least the portion of the treatment fluid from the first roller to the second roller includes transferring at least the portion of the first coating of the treatment fluid from the first roller to the second roller to form a substantially uniform second coating of the treatment fluid on the second roller, the second coating having a thickness less than the first coating; and the transferring of at least the portion of the treatment fluid from the second roller to the print substrate includes transferring at least the portion of the second coating of the treatment fluid from the second roller to the print substrate to form a substantially uniform third coating of the treatment fluid less than 0.4 micrometers thick on the print substrate.

24. A method as defined in claim 23, wherein the carrier fluid includes an isoparaffinic carrier fluid.

* * * * *